United States Patent [19]

Carre et al.

[11] 4,416,548

[45] Nov. 22, 1983

[54] APPARATUS FOR GAS OR LIQUID ADMIXTURE

[75] Inventors: Olof G. Carre, Alnö; Paul W. Josefsson, Sörberge; Lars E. Näsman, Alnö; Stig B. H. Zetterqvist, Sundsbruk, all of Sweden

[73] Assignee: Sunds Defibrator Aktiebolag, Sweden

[21] Appl. No.: 234,786

[22] Filed: Feb. 17, 1981

[30] Foreign Application Priority Data

Mar. 13, 1980 [SE] Sweden ..... 8001970

[51] Int. Cl.[3] ..... B01F 7/12

[52] U.S. Cl. ..... 366/168; 366/178; 366/303; 366/305; 366/307

[58] Field of Search ..... 366/303, 305, 307, 168, 366/176, 178, 262, 264, 315, 317; 241/46.06, 46.11, 162, 163

[56] References Cited

U.S. PATENT DOCUMENTS

| | | | |
|---|---|---|---|
| 1,496,641 | 6/1924 | Hurrell | 366/264 X |
| 2,738,931 | 3/1956 | Schneider | 366/264 X |
| 2,912,343 | 11/1959 | Collins et al. | 366/303 X |
| 2,960,318 | 11/1960 | Caillaud | 366/303 X |
| 3,018,091 | 1/1962 | Duggins | 366/317 X |
| 3,744,763 | 7/1973 | Schnoring et al. | 366/303 X |
| 3,960,332 | 6/1976 | Seifert | 241/46.06 |
| 3,991,945 | 11/1976 | Kolb | 241/163 X |

FOREIGN PATENT DOCUMENTS

| | | | |
|---|---|---|---|
| 1388889 | 3/1975 | United Kingdom | 366/264 |

*Primary Examiner*—Philip R. Coe

*Attorney, Agent, or Firm*—Lerner, David, Littenberg & Krumholz & Mentlik

[57] ABSTRACT

Methods and apparatus for continuously mixing fluid processing media with pulp suspensions are disclosed. The method includes supplying pulp suspensions to the central portion of the substantially planar radial face of a cylindrical rotor, feeding a fluid processing medium to the pulp suspension as it approaches the rotor face, forming an annular gap at the axial outer surface of the rotor, so that the rapid rotation of the rotor causes the pulp suspension and fluid processing medium to flow radially outward along the planar face and to pass axially through the annular gap, and effecting turbulence between the pulp suspension and the fluid processing medium at the entrance to that gap. The apparatus disclosed includes a cylindrical rotor having a substantially planar radial face and an axial outer surface, a housing surrounding the rotor including a pulp suspension inlet facing the center of the radial face of the rotor, and an outlet proximate to its axial outer surface, an annular gap between the axial outer surface and the housing along a predetermined portion of the axial outer surface of the rotor, a processing medium inlet for feeding the fluid processing medium to the pulp suspension inlet, and turbulence creating fingers located at the periphery of the substantially planar radial face of the rotor to create turbulence in the pulp suspension at the entrance to the annular gap.

16 Claims, 8 Drawing Figures

APPARATUS FOR GAS OR LIQUID ADMIXTURE

FIELD OF THE INVENTION

The present invention relates to apparatus for mixing processing fluids with pulp suspensions. More particularly, the present invention relates to apparatus for continuously mixing processing liquids or gases with pulp suspensions.

BACKGROUND OF THE INVENTION

Mixing processes in general, and chemical mixing processes in particular, play an important role in substantially the entire cellulose processing industry. For example, during the bleaching of cellulose pulps, it is absolutely essential to obtain good chemical mixture in order to realize satisfactory delignification and/or bleaching thereof. The obtaining of such proper mixing of bleaching chemicals enables one to realize homogeneous bleaching results as well as good utilization of chemicals at the lowest possible reaction temperatures and shortest possible reaction times.

The "mixing problem" which to the present date has appeared to be the most difficult to solve in the cellulose industry so as to obtain acceptable results has been the mixing of chemicals to pulp suspensions at mean pulp or filter concentrations (i.e., of from about 5 to 20%). The mixing of bleaching chemicals with pulp suspensions of low concentrations, (e.g., below 5%, such as in conventional chlorination) and the addition of bleaching chemicals in a gaseous state at high concentrations (e.g., above 20%, as in gaseous phase bleaching), are, however, well-known and thoroughly tested methods which have not given rise to any appreciable mixing problems.

One problem which has been encountered during such mixing at low pulp concentrations, however, is that in view of the large liquid volumes present high pump energy is required, and in addition large amounts of emissions are effected from corresponding bleaching plants.

On the other hand, operations at high pulp concentrations (such as above 20%) means that exclusive equipment is required in order to obtain a high degree of dewatering, and the bleaching chemicals must exist as gaseous media during processing for known reasons. So-called gaseous phase bleaching at high pulp concentrations (such as above 20%) has been and still is being carried out on a technical scale for bleaching with gaseous chemicals such as oxygen, ozone, chlorine, ammonia, and chlorine dioxide.

SUMMARY OF THE INVENTION

In accordance with the present invention, apparatus has now been developed for the homogeneous and efficient mixing of both gaseous and liquid media with pulp suspensions at mean concentrations such as from 5 to 20%. In accordance with this: apparatus intensive mixing with momentary admixture of chemicals to the pulp suspension is obtained. In this context, momentary admixture is understood to mean that the mixing device (the mixer) is a proper sense "lacks" retention time, and the chemicals and pulp suspension at all times are added continuously and simultaneously to the mixer. In other words, the mixer has no significant balancing effect with respect to "more rapid" concentration variations, for example, as is often the case with conventional low concentration mixers. The present invention is thus based upon the fact that in order to obtain sufficient admixture of a liquid or gaseous chemical, such as oxygen gas, chlorine gas, chlorine dioxide water, or a mixture of chlorine and chlorine dioxide, with a pulp suspension, the principal requirement is that fibers in the suspension are well exposed, and that thereafter the chemicals are added to these free fibers as uniformly as possible.

Thus, in accordance with the method of using the apparatus of the present invention it has been found that a fluid (i.e., gas or liquid) processing medium may be continuously mixed with a pulp suspension by supplying the pulp suspension to the central portion of the substantially planar radial face of a cylindrical rotor, feeding the fluid processing medium to the pulp suspension as it approaches the rotor face, forming an annular gap at the axial outer surface of the rotor, so that the rapid rotation of the rotor causes both the pulp suspension and the fluid processing medium to flow radially outward along the planar radial face and to pass axially through the annular gap, and effecting turbulence between the pulp suspension and the fluid processing medium at the entrance to that gap.

In a preferred embodiment of the method of using the apparatus of the present invention, the fluid processing medium is fed to the pulp suspension at the center of the substantially planar radial face of the rotor. Preferably, additional turbulence is effected in the pulp suspension within the annular gap itself. More preferably, the pulp suspensions employed will have a concentration of from about 5 to 20%.

In accordance with the apparatus of the present invention it has been found that fluid pulp media and pulp suspensions can be continuously mixed by employing an apparatus including a cylindrical rotor including a substantially planar radial face and a cylindrical axial outer surface, a housing surrounding the rotor, including a pulp suspension inlet facing the center of the substantially planar radial face of the rotor and an outlet proximate to the cyndrical axial outer surface of the rotor, gap means for forming an annular gap between the axial cylindrical outer surface of the rotor and the housing along a predetermined portion of the axial outer surface of the rotor, processing medium inlet means for feeding the fluid processing medium to the pulp suspension inlet, and turbulence creating means located at the periphery of the substantially planar radial face of the rotor so as to create turbulence in the pulp suspension at the entrance to the annular gap. In one embodiment of the apparatus of the present invention the gap means comprises an annular stator affixed to the housing.

In another embodiment of the apparatus of the present invention the fluid processing medium inlet means feeds the fluid processing medium to the center of the substantially planar radial face of the rotor.

In another embodiment of the apparatus of the present invention the outlet of the housing is located tangentially with respect to the rotor, and adjacent to the exit from the gap.

In a preferred embodiment of the apparatus of the present invention the housing includes a collecting space located axially with respect to the rotor on the side of the housing facing the rotor face so that materials in the pulp suspension unable to pass through the gap can collect in that collecting space. In another embodiment of the apparatus of the present invention, turbulence creating means are also located within the gap itself, preferably affixed to the cylindrical axial outer surface of the rotor and/or the gap forming means, such as the stator.

In yet another embodiment of the apparatus of the present invention the rotor includes a plurality of cylindrical axial outer surfaces and the gap forming means includes a plurality of gap forming members alternating with the plurality of cylindrical axial outer surfaces of the rotor so as to form a plurality of such gaps.

The characterizing features of the present invention will become more apparent with reference to the following detailed description and claims. The following detailed description may be more fully understood with reference to the accompanying drawings, wherein FIG. 1 is a side, elevational, partially cross-sectional view of an apparatus in accordance with the present invention;

DETAILED DESCRIPTION

Figure 1:
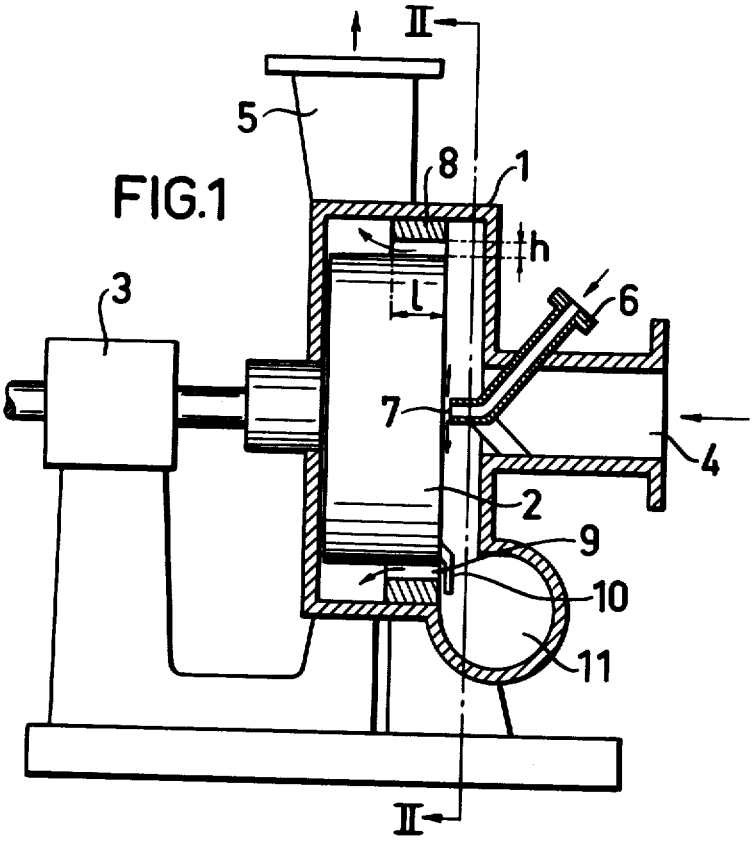
Figure 2:
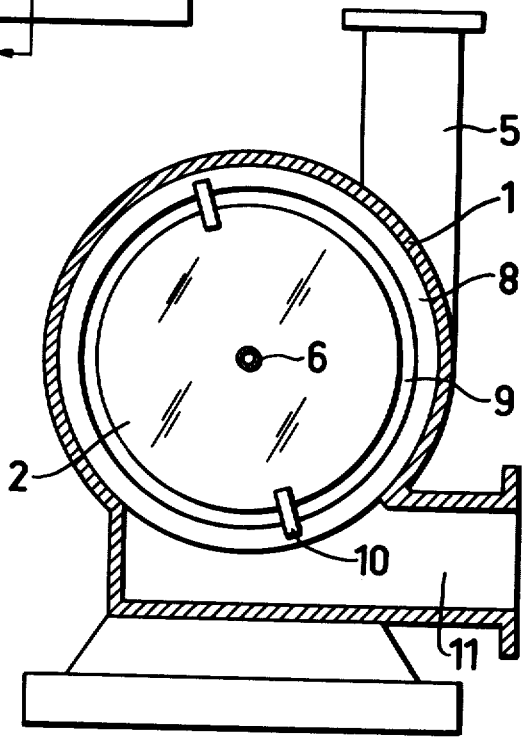
FIG. 2 is a front, partially sectional view of the apparatus of FIG. 1 taken along section II—II thereof.
Figure 3:
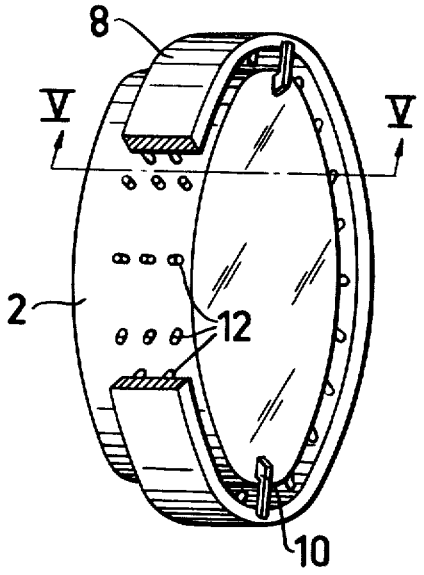
FIG. 3 is an elevational perspective partially sectional view of a portion of the apparatus of the present invention including a rotor.
Figure 4:
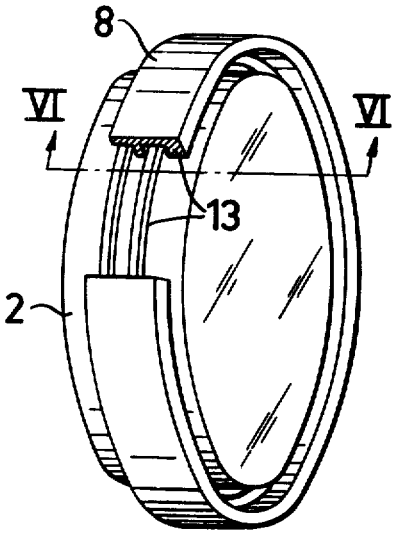
FIG. 4 is another elevational perspective partially sectional view of a portion of the apparatus of the present invention, including a rotor.
Figure 5:
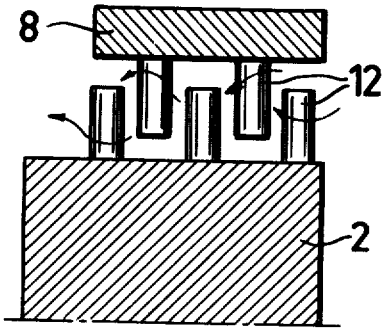
FIG. 5 is a sectional perspective view of the apparatus of FIG. 3 taken along section V—V thereof.
Figure 6:
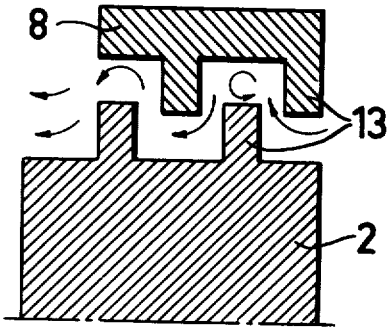
FIG. 6 is a perspective sectional view of the apparatus of FIG. 4 taken along section VI—VI thereof.

Referring to the figures, in which like numerals refer to like portions thereof, the apparatus shown in FIG. 1 includes a cylindrical housing 1, in which cylindrical rotor 2 rotates. The rotor 2 is supported in an external bearing housing 3 and driven by a motor (not shown). The inlet 4 to the mixer housing is centrally located relative to the cylindrical rotor 2 while the outlet 5 is tangentially located on the cylindrical housing 1. An inlet 6 for the addition of chemical media is located symmetrically within inlet 4 and opens into the center 7 of the rotor 2. When the diameter of rotor 2 is relatively great with respect to the diameter of the inlet 4, inlet 6 can open into the center 7 of the rotor 2, although not necessarily, while still opening into pulp inlet 4. Between the cylindrical rotor 2 and the stator ring 8 attached to the housing 1, a circular or annular gap 9 is obtained. The gap 9 may be defined outwardly by a portion of the housing 1 itself instead of by a specially designed stator ring 8. The height h of the gap should be from about 1 to 30 millimeters, preferably between about 2 and 10 millimeters, and most preferably between about 3 and 5 millimeters. The length of 1 of the gap should be such that an efficient mixture is obtained in the gap. That is, 1 should exceed h by several times, suitably between 3 and 25 times, preferably between 5 and 20 times, and most preferably between 10 and 15 times. At the outer periphery of the rotor 2 a number of cleaning fingers 10 are located. A space 11 is designed at the bottom of housing 1 to act as a scrap trap. In place of cleaning finger 10 other members such as semi-spherical projecting portions or the like may be provided at the periphery of rotor 2 for effecting turbulence in the pulp suspension.

The apparatus of the present invention operates as follows. Pulp at a concentration of up to a maximum of about 20% is supplied continuously to the mixer through inlet 4. In view of the rotation of the cylindrical rotor 2, a shearing field is formed between the pulp and the rotor 2, that field being capable of causing the pulp at a certain pressure drop to pass the relatively narrow gap 9 between the cylindrical rotor 2 and the stator 8. By the action of an intensive shearing field both at the entrance into and within the gap, the fibers in the pulp suspension are efficiently exposed. Having passed through the gap, in this manner the pulp is then pressed out of the mixer through outlet 5.

In the same continuous manner as the pulp suspension is fed into the mixer, the chemical or chemicals to be mixed with the pulp suspension are also fed into the mixer through chemical inlet 6. In view of the fact that the chemicals are charged to the center of the rapidly rotating rotor 2 (the rotor 2 generally rotates at from 500 to 1500 r.p.m., preferably about 750 r.p.m.) a uniform and homogeneous distribution of these added chemicals is obtained radially outward along the planar cylindrical front surface to the outer edge of the rotor and to the gap. These added chemicals are thus distributed about the gap, and each "pulp layer" forced through the gap is apportioned with accurately equal amounts of such chemicals.

By adding these chemicals to the center of the rapidly rotating rotor, as shown in FIG. 1, in addition to such uniform chemical distribution to the pulp suspension within the gap, the further advantages obtained in that the shearing force between the rotating smooth front surface of the rotor 2 and the pulp suspension is substantially reduced in view of the formation of the chemical layer closest to the rotor surface. This phenomenon is particularly noticeable when employing gaseous chemicals such as chlorine or oxygen gas. Thus, in this manner the friction between the pulp suspension and the rotor 2 is reduced, and it also becomes possible to utilize a greater part of the energy employed for useful mixing work both at the entrance to and within gap 9 itself.

The aforementioned cleaning fingers 10 in addition to acting as "scrap ejectors" to the scrap trap 11, also serve as fiber exposing and mixing means when the pulp and chemicals are entering into the gap itself. In order to improve the mixing within the gap at substantial gap heights h, such as above 5 millimeters, different turbulence-forming members can be employed on the rotor 2, and on stator 8, respectively, as is shown in FIGS. 3 through 6. The object in these cases is to increase the energy turnover in the gap, i.e., the transfer of energy from the rotor 2 through the pulp layer to the stator 8, so as to obtain an increase in mixing capacity. These turbulence forming members may, for example, have the form of pins 12 or strips 13 extending about the rotor and, respectively, the stator.

Pins 12, which may also have forms other than those shown in the drawings, such as being semi-spherical in shape, etc., can be provided on the rotor 2, or on the stator 8, or on both. In the latter case, they should extend past each other. Strips 13 extending around the entire periphery of the rotor may include a single strip or several in number, and should be located on both the rotor 2 and the stator 8. They preferably extend sufficiently into the gap so that their pins are located on about the same diameter.

Figure 7:
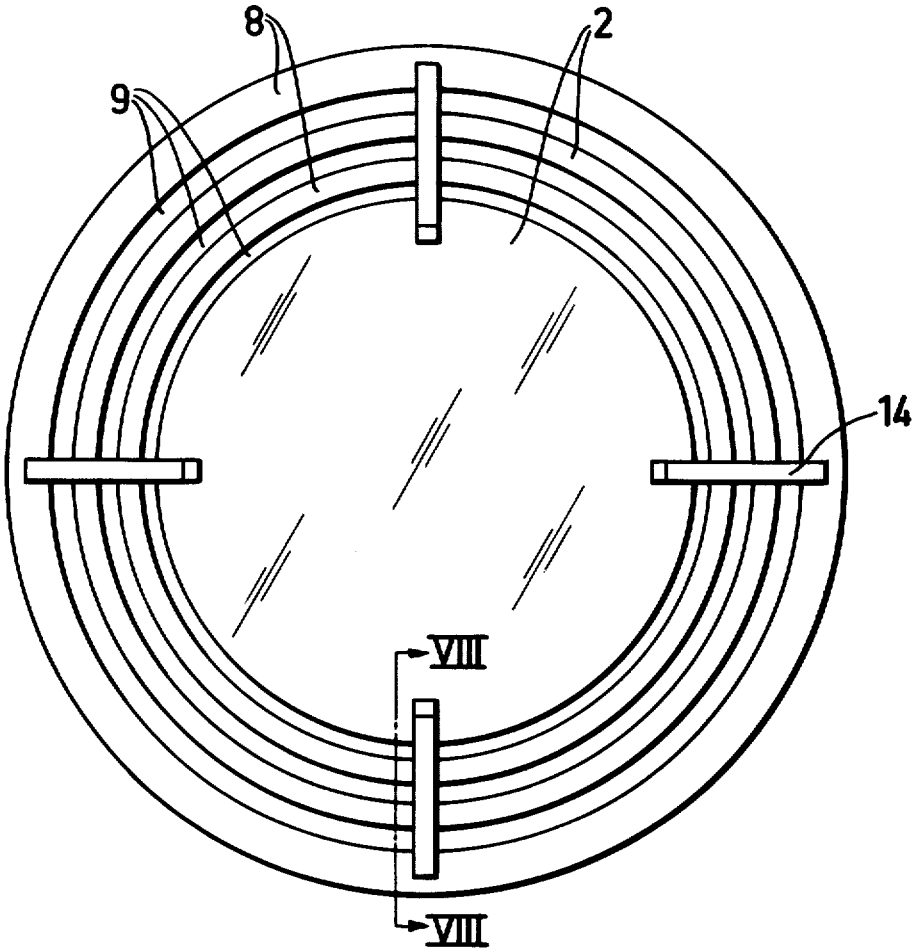
FIG. 7 is a front elevational view of a portion of the apparatus of the present invention including a rotor.
Figure 8:
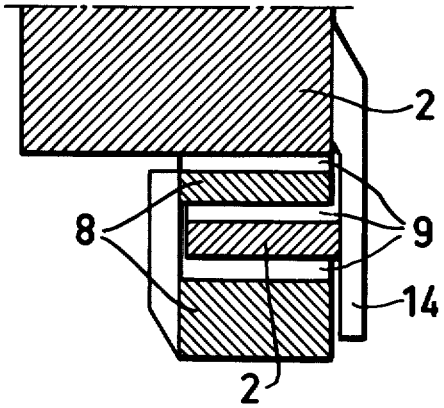
FIG. 8 is a perspective partly sectional view of the apparatus of FIG. 7 taken along section VIII—VIII thereof.

One method of increasing the capacity of such a mixer is to design the rotor and the stator so that several gaps are formed as shown in FIGS. 7 and 8. For example, from three to seven gaps may be formed, preferably from three to five gaps, and most preferably three gaps. In this manner, the open area, and thus the mixer capacity, can be increased within a given gap height. In order to render it possible to distribute the chemicals which have been charged (either in a gaseous or liquid state) to the center of the rotor, and uniformly over several gaps located concentrically outside one another, a number of "spokes" 14 are provided on the rotor 2 in front of the gaps. These spokes 14, in addition to acting as scrap ejectors and fiber exposers, also serve as turbulence formers and distributors of the chemicals uniformly over the different gaps. A front side of rotor 2 may be plain or tapered, in which case the pointed end can face towards or away from inlet 4. The rear face of rotor 2 may be smooth or can be provided with ribs, elevations, or the like, so as to prevent stagnation of the suspension behind the rotor.

In order to obtain an optimum mixture in all respects, it has been found that the ratio between the gap length l and the gap height h and the rotor diameter should be selected for specific rotor speeds and production levels through the mixer. For example, in the case employing a rotor with three circular gaps where h equals 4 millimeters, l equals 50 millimeters, and the rotor diameter is 500 millimeters, a capacity of 450 tons per 24 hours has been measured at a pulp concentration of from 8 to 12%. At a rotor speed of 750 r.p.m., an evaluation of the mixer was substantially carried out in a pilot plant for the oxygen gas delignification at an average pulp concentration (i.e., from 5 to 20%), and most particularly at about 10%. During the evaluation of the mixer, the reaction kinetics for the oxygen gas delignification at average pulp concentrations was compared with the kinetics for oxygen gas delifnification at about 30% pulp concentration. By employing the mixer designed described herein, an astonishingly good result was obtained. The bleaching result obtained by this mixer was, in all respects, as good as that at oxygen gas delignification at 30% pulp concentration (gaseous phase bleaching).

What is claimed is:

1. Apparatus for continuously mixing a fluid processing medium with a pulp suspension comprising a cylindrical rotor including a planar radial face and a cylidrical axial outer surface, a housing surrounding said rotor, said housing including a pulp suspension inlet facing the center of said substantially planar radial face of said rotor and an outlet proximate to said cylindrical axial outer surface of said rotor, gap means for forming an annular gap between said cylindrical axial outer surface of said rotor and said housing along a predetermined portion of said cylindrical axial outer surface of said rotor, said planar radial face being free of mixing protrusions and allowing a substantially unimpeded flow of said pulp suspension to permit mixing of said pulp suspension at said gap means, processing medium inlet means for feeding said fluid processing medium to said pulp suspension inlet, and turbulence creating means located at the periphery of said planar radial face of said rotor so as to create turbulence in said pulp suspension at the entrance to said annular gap.

2. The apparatus of claim 1 wherein said gap means comprises an annular stator affixed to said housing.

3. The apparatus of claim 1 wherein said fluid processing medium inlet means feeds said fluid processing medium to the center of said planar radial face of said rotor.

4. The apparatus of claim 1 wherein said outlet of said housing is located tangentially with respect to said rotor and adjacent to the exit from said gap.

5. The apparatus of claim 1 wherein said housing includes a collecting space located axially on the side of said housing facing said planar radial face of said rotor, whereby material which is unable to pass through said gap may collect in said collecting space.

6. The apparatus of claim 1 including turbulence forming means located within said gap.

7. The apparatus of claim 6 wherein said turbulence forming means located within said gap is affixed to said cylindrical axial outer surface of said rotor.

8. The apparatus of claim 6 wherein said turbulence forming means located within said gap is affixed to said gap forming means.

9. The apparatus of claim 6 wherein said turbulence forming means located within said gap is affixed to both said cylindrical axial outer surface of said rotor and said gap forming means.

10. The apparatus of claim 1 wherein said rotor includes a plurality of said cylindrical axial outer surfaces and said gap forming means includes a plurality of gap forming members alternating with said plurality of cylindrical axial outer surfaces of said rotor so as to form a plurality of said gaps therein.

11. Apparatus for continuously mixing fluid processing medium with a pulp suspension comprising a cylindrical rotor including a planar radial face and a cylindrical axial outer surface, a housing surrounding said rotor, said housing including a pulp suspension inlet facing the center of said substantially planar radial face of said rotor and an outlet proximate to said cylindrical axial outer surface of said rotor, gap means for forming an annular gap between said cylindrical axial outer surface of said rotor and said housing along a predetermined portion of said cylindrical axial outer surface of said rotor, said annular gap having a height of between about 1 and 30 millimeters, and a length corresponding to said predetermined portion of said cylindrical axial outer surface of said rotor, said length being substantially less than the length of the cylindrical outer surface of said rotor, said planar radial face being free of mixing protrusions and allowing a substantially unimpeded flow of said pulp suspension to permit mixing of said pulp suspension at said gap means, processing medium inlet means for feeding said fluid processing medium to said pulp suspension inlet, and turbulance creating means located at the periphery of said planar radial face of said rotor so as to create turbulence in said pulp suspension at the entrance to said annular gap.

12. The apparatus of claim 11 wherein said height of said gap is between about 2 and 10 millimeters.

13. The apparatus of claim 11 wherein the height of said gap is between about 3 and 5 millimeters.

14. The apparatus of claim 11 wherein the length of said gap is between about 3 and 25 times the height of said gap.

15. The apparatus of claim 11 wherein the length of said gap is between about 5 and 20 times the height of said gap.

16. The apparatus of claim 11 wherein the length of said gap is between about 10 and 15 times the height of said gap.

* * * * *